US009214310B2

(12) United States Patent
Boyer

(10) Patent No.: US 9,214,310 B2
(45) Date of Patent: Dec. 15, 2015

(54) SERVICE DISCONNECT ASSEMBLY

(71) Applicant: Tyco Electronics Corporation, Berwyn, PA (US)

(72) Inventor: James Aric Boyer, Troy, MI (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 519 days.

(21) Appl. No.: 13/663,049

(22) Filed: Oct. 29, 2012

(65) Prior Publication Data

US 2014/0118103 A1 May 1, 2014

(51) Int. Cl.

| | |
|---|---|
| ***H01H 85/02*** | (2006.01) |
| ***H01H 85/20*** | (2006.01) |
| *H01H 9/28* | (2006.01) |
| *H01H 85/25* | (2006.01) |

(52) U.S. Cl.

CPC ..... *H01H 85/20* (2013.01); *H01H 9/287* (2013.01); *H01H 9/281* (2013.01); *H01H 85/25* (2013.01)

(58) Field of Classification Search

CPC ..... H01H 85/20; H01H 9/287; H01H 9/281; H01H 85/25

USPC ..... 337/194, 196, 205, 211; 361/642, 626, 361/646, 837; 439/157, 620.26, 620.29, 439/620.34, 620.3, 893

See application file for complete search history.

(56) References Cited

U.S. PATENT DOCUMENTS

| | | | | | |
|---|---|---|---|---|---|
| 1,966,716 | A | * | 7/1934 | Green | 337/194 |
| 2,039,589 | A | * | 5/1936 | Frank | 337/211 |
| 2,072,729 | A | * | 3/1937 | Corbett | 337/196 |
| 2,186,813 | A | * | 1/1940 | Frederick et al. | 337/210 |
| 2,289,122 | A | * | 7/1942 | Jackson et al. | 337/188 |
| 3,030,474 | A | * | 4/1962 | Scott, Jr. | 337/7 |
| 3,202,788 | A | * | 8/1965 | George | 337/194 |
| 3,358,100 | A | * | 12/1967 | Schleicher | 337/194 |
| 3,379,842 | A | * | 4/1968 | Downs et al. | 337/146 |
| 4,778,959 | A | * | 10/1988 | Sabatella et al. | 218/1 |
| 4,851,963 | A | * | 7/1989 | Miller et al. | 361/643 |
| 4,966,561 | A | * | 10/1990 | Norden | 439/620.34 |
| 5,186,637 | A | * | 2/1993 | Norden | 439/133 |
| 5,406,449 | A | * | 4/1995 | Hicks et al. | 361/616 |
| 5,559,662 | A | * | 9/1996 | Happ et al. | 361/104 |
| 5,831,228 | A | * | 11/1998 | Kuki et al. | 200/16 E |
| 5,833,484 | A | * | 11/1998 | Post et al. | 439/352 |
| 5,842,560 | A | * | 12/1998 | Kuki et al. | 200/43.05 |
| 5,973,418 | A | * | 10/1999 | Ciesielka et al. | 307/130 |
| 6,157,287 | A | * | 12/2000 | Douglass et al. | 337/198 |
| 6,310,291 | B1 | * | 10/2001 | Clough | 174/67 |
| 6,317,312 | B1 | * | 11/2001 | Hashizawa et al. | 361/642 |
| 6,325,647 | B1 | * | 12/2001 | May et al. | 439/157 |
| 6,333,846 | B1 | * | 12/2001 | Hashizawa et al. | 361/649 |
| 6,366,449 | B1 | * | 4/2002 | Hashizawa et al. | 361/642 |

(Continued)

FOREIGN PATENT DOCUMENTS

| | | | | | |
|---|---|---|---|---|---|
| DE | 102007053535 | A1 | * | 5/2009 | H02B 1/20 |
| GB | 2322742 | A | * | 9/1998 | H01H 85/25 |

*Primary Examiner* — Anatoly Vortman

(57) ABSTRACT

A service disconnect assembly includes a receiver assembly having a fuse receptacle that is configured to receive a fuse therein. The service disconnect assembly includes a lockout device having a latch. The latch is actuatable between a latched position and an unlatched position. The latch cooperates with the receiver assembly in the latched position such that the lockout device cannot be removed from the receiver assembly. The latch is configured to be locked in the latched position.

20 Claims, 6 Drawing Sheets

(56) References Cited

U.S. PATENT DOCUMENTS

| | | | | |
|---|---|---|---|---|
| 6,407,656 | B1 * | 6/2002 | Konda et al. | 337/194 |
| 6,587,028 | B2 * | 7/2003 | Mollet et al. | 337/194 |
| 6,650,222 | B2 * | 11/2003 | Darr et al. | 337/187 |
| 6,717,505 | B1 * | 4/2004 | Bruchmann | 337/194 |
| 6,727,797 | B1 * | 4/2004 | Bruchmann | 337/210 |
| 6,736,655 | B2 * | 5/2004 | Martin et al. | 439/157 |
| 6,784,783 | B2 * | 8/2004 | Scoggin et al. | 337/194 |
| 6,853,289 | B2 * | 2/2005 | Scoggin | 337/194 |
| 6,997,725 | B2 * | 2/2006 | Stella et al. | 439/157 |
| 6,998,954 | B2 * | 2/2006 | Milanczak | 337/194 |
| 7,355,503 | B2 * | 4/2008 | Buettner | 337/211 |
| 7,474,194 | B2 * | 1/2009 | Darr et al. | 337/72 |
| 7,561,017 | B2 * | 7/2009 | Darr et al. | 337/79 |
| 7,750,789 | B2 * | 7/2010 | Titokis et al. | 337/194 |
| 7,791,864 | B2 * | 9/2010 | Matyas et al. | 361/630 |
| 7,893,809 | B2 | 2/2011 | Head | |
| 8,562,368 | B2 * | 10/2013 | Boyer | 439/345 |
| 2005/0098419 | A1 * | 5/2005 | Matsui et al. | 200/311 |
| 2008/0242150 | A1 * | 10/2008 | Chikamatsu et al. | 439/620.3 |
| 2009/0246992 | A1 * | 10/2009 | Martin | 439/157 |
| 2012/0056708 | A1 * | 3/2012 | Ventura et al. | 337/207 |

* cited by examiner

SERVICE DISCONNECT ASSEMBLY

BACKGROUND OF THE INVENTION

The subject matter described and/or illustrated herein relates generally to electrical power sources, and more particularly, to service disconnect assemblies for electrical power sources.

Electronic modules are used as power supplies, for example as battery packs for automotive applications. The electronic modules typically include a service disconnect assembly for disconnecting electrical power from the battery packs to the other components of the vehicle, for example the motor. Service disconnect assemblies typically include a receiver that receives a fuse. The fuse electrically interconnects power terminals of the power supply to complete a power circuit of the power supply. The fuse can be removed from the receiver to open the power circuit, thus breaking the flow of electrical power through the power circuit.

An exemplary use for a service disconnect assembly is disconnecting the flow of electrical power to protect an operator or technician when servicing or repairing the electronic module, and/or to protect first responders to an accident. But, the fuse can be reinstalled into the receiver of the service disconnect assembly during such service, repair, and/or response. For example, another person besides the operator or technician may reinstall the fuse while the operator or technician is servicing or repairing the vehicle, which may expose the operator or technician to the electrical power.

BRIEF DESCRIPTION OF THE INVENTION

In one embodiment, a service disconnect assembly includes a receiver assembly that includes a fuse receptacle that is configured to receive a fuse therein. The service disconnect assembly includes a lockout device having a latch. The latch is actuatable between a latched position and an unlatched position. The latch cooperates with the receiver assembly in the latched position such that the lockout device cannot be removed from the receiver assembly. The latch is configured to be locked in the latched position.

In another embodiment, a service disconnect assembly includes a receiver configured to hold terminals of a power circuit in a spaced apart relationship. The receiver includes a fuse receptacle that is configured to receive a fuse therein that completes an electrical path between the terminals. The receiver further includes a latch element. The service disconnect assembly includes a cover that is configured to be mounted to the receiver to close the fuse receptacle such that the fuse receptacle is inaccessible for receiving the fuse therein. The cover is configured to be locked onto the receiver using a lock such that the cover cannot be dismounted from the receiver without unlocking the lock.

In another embodiment, a power source assembly includes a power source and a service disconnect assembly operatively connected to the power source for selectively supplying electrical power from the power source to an electrical load. The service disconnect assembly includes a receiver configured to hold terminals of a power circuit in a spaced apart relationship. The receiver includes a fuse receptacle that is configured to receive a fuse therein that completes an electrical path between the terminals. The receiver further includes a latch element. The service disconnect assembly also includes a lockout device having a cover and a latch. The cover is configured to be mounted to the receiver to close the fuse receptacle. The latch is actuatable between a latched position and an unlatched position. The latch cooperates with the latch element of the receiver in the latched position such that the cover cannot be removed from the receiver. The latch is configured to be locked in the latched position.

DETAILED DESCRIPTION OF THE INVENTION

Figure 1:
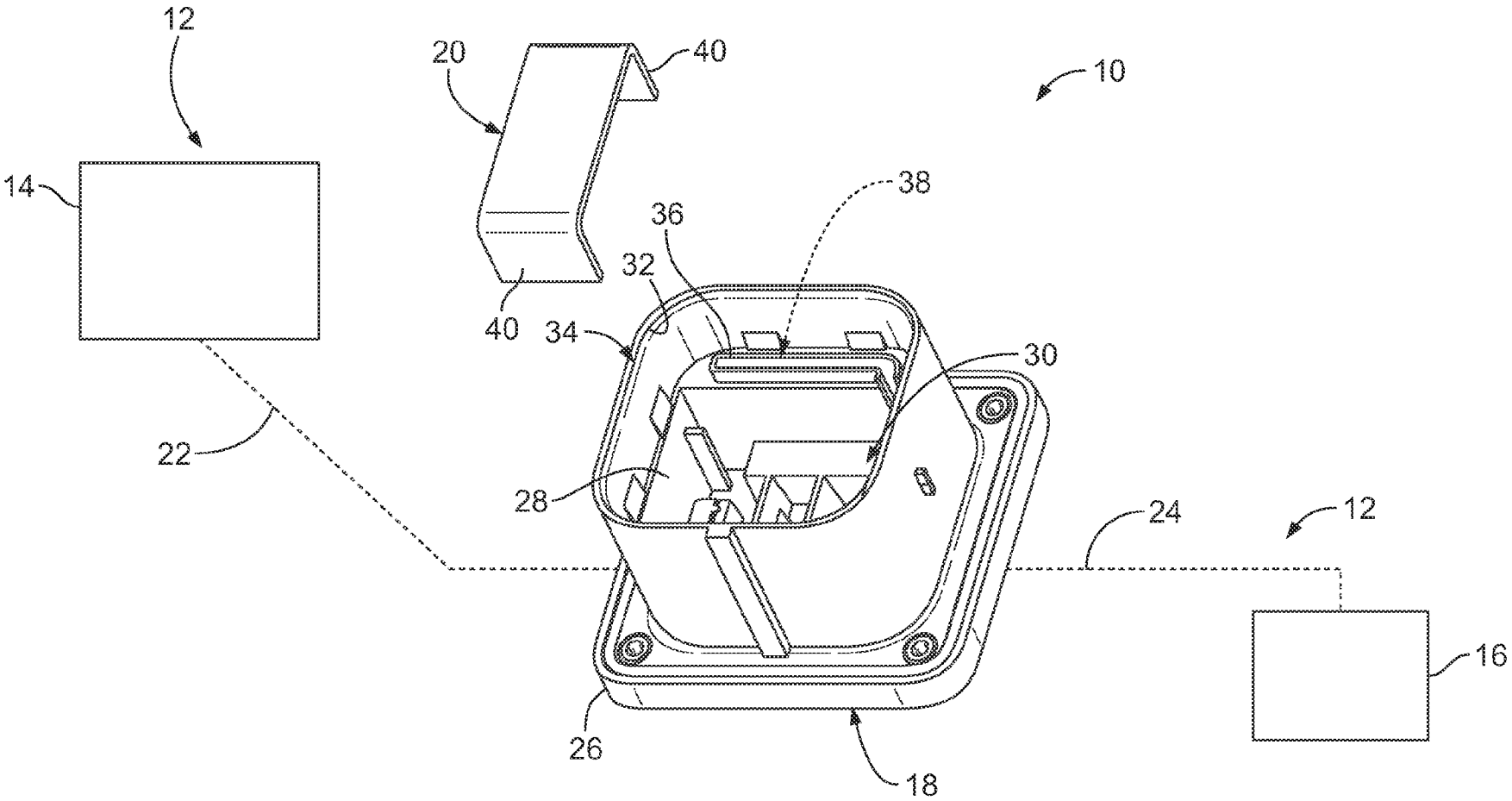
FIG. 1 is an exploded perspective view of an exemplary embodiment of a receiver assembly of an exemplary embodiment of a service disconnect assembly shown schematically in an exemplary power circuit.

FIG. 1 is an exploded perspective view of an exemplary embodiment of a receiver assembly 18 of an exemplary embodiment of a service disconnect assembly 10 (shown in FIGS. 3-8) shown schematically in an exemplary power circuit 12. The service disconnect assembly 10 forms part of the power circuit 12, which is represented schematically in FIG. 1. The service disconnect assembly 10 is used to disconnect service of the power circuit 12 when opened.

The power circuit 12 includes a source of electrical power 14 and one or more electrical loads 16 that are powered by the power source 14. The service disconnect assembly 10 is provided in line between the power source 14 and the electrical load(s) 16. For clarity, the service disconnect assembly 10 will be described and illustrated herein with respect to a single electrical load 16. But, it should be understood that the service disconnect assembly 10 may be provided in line between the power source 14 and any number of electrical loads 16.

The service disconnect assembly 10 includes a receiver assembly 18 that is configured to receive a fuse 20. When the fuse 20 is received by the receiver assembly 18, the fuse 20 completes the electrical flow path of the power circuit 12 such that electrical power flows from the power source 12, through the service disconnect assembly 10, to the electrical load 16. The fuse 20 can be removed from the receiver assembly 18 to interrupt the electrical flow path of the power circuit 12 from the power source 14 to the electrical load 16. When the fuse 20 is removed from the receiver assembly 18, power cannot flow through the service disconnect assembly from the power source 14 to the electrical load 16.

Specifically, when the fuse 20 is received by the receiver assembly 18, the receiver assembly 18 electrically interconnects power cables 22 and 24 (illustrated schematically herein) of the power circuit 12. The power cable 22 extends from the power source 14 to the receiver assembly 18, while the power cable 24 extends from the electrical load 16 to the receiver assembly 18. The receiver assembly 18 includes a housing 26 and an insert 28 that is held by the housing 26. The housing 26 and the insert 28 define a fuse receptacle 30 that receives the fuse 20 therein. The fuse receptacle 30 includes an open end, or entrance, 32 at an end 34 of the housing 26. The fuse receptacle 30 is accessible through the entrance 32. The insert 28 may include two or more terminal channels 36, only one of which is visible in FIG. 1.

In the exemplary embodiment, each power cable 22 and 24 includes a terminal 38 mounted to an end of the cable 22 and 24. The terminal 38 of each power cable 22 and 24 extends within, or is exposed to, a corresponding one of the terminal channels 36. The terminal channels 36, and thus the terminals 38, are spaced apart from each other along the fuse receptacle 30 such that the terminals 38 are held by the receiver assembly 18 in a spaced apart relationship. Accordingly, the terminals 38 are not directly electrically connected to one another. Rather, the fuse 20 includes blades 40 that are received within corresponding terminal channels 36 such that each blade 40 engages, and thereby electrically connects to, a corresponding one of the terminals 38. When the fuse 20 is installed within the fuse receptacle 30 of the receiver assembly 18, the fuse 20 completes an electrical path between the terminals 38 such that the terminals 38 are electrically connected to each other. The fuse 20 can be removed from the receiver assembly 18 to electrical disconnect the terminals 38 from each other and thereby interrupt the electrical flow path of the power circuit 12 from the power source 14 to the electrical load 16.

As will be described in more detail below, the service disconnect assembly 10 includes a lockout device 42 (FIGS. 2-8) that is configured to be mounted to the receiver assembly 18 to cover the entrance 32 of the fuse receptacle 30 when the fuse 20 is not installed within (e.g., has been removed from) within the receiver assembly 18. The lockout device 42 can be locked onto the receiver assembly 18 to prevent the fuse 20 from being installed into the receiver assembly 18 without unlocking the lockout device 42.

In some alternative embodiments, the terminals 38 are intervening electrical contacts that are engaged with, and thereby electrically connected to, electrical contacts (not shown) that are mounted to the ends of the corresponding power cables 22 and 24. Moreover, the fuse 20, the terminals 38, and the fuse receptacle 30 are each not limited to the structure, configuration, geometry, and/or the like shown herein, nor are the fuse 20, the terminals 38, and the fuse receptacle 30 limited to the manner in which the fuse 20 electrically connects to the terminals 38. Rather, the fuse 20, the terminals 34, and the fuse receptacle 30 may additionally or alternatively include any other structure, configuration, geometry, and/or the like that enables the fuse 20 to electrically connect to the terminals 38 and provide an electrical path between the terminals 38. For example, in some embodiments, the insert 28 of the fuse receptacle 30 does not include the terminal channels 36. In some embodiments, the fuse 20 is held by a fuse holder (not shown) that mechanically couples to the fuse receptacle 30 of the receiver assembly 18 by mechanically coupling the fuse holder to the receiver assembly 18. The fuse holder may be commonly referred to as a "service disconnect" and/or "service disconnect element".

The housing 26 and the insert 28 of the receiver assembly 18 are box shaped in the exemplary embodiment, however, the housing 26 and the insert 28 may each additionally or alternatively include any other shape. While the housing 26 and the insert 28 are shown herein as discrete components, the receiver assembly 18 may include a single element that defines the housing 26 and the insert 28. In such an embodiment, the insert 28 may be integrally formed with the housing 26. In some embodiments, the receiver assembly 18 includes a high-voltage interlock (HVIL) system (not shown).

In the exemplary embodiment, the power circuit 12 is a power circuit of an automotive application, for example for an alternative fuel type of vehicle, such as, but not limited to, a hybrid car, an electric car, and/or another type of electrically powered vehicle. But, the power circuit 12 is not limited to alternative fuel type vehicles, nor is the power circuit 12 limited to vehicles in general. Rather, the power circuit 12 may be any type of power circuit, such as, but not limited to, a power circuit for a conventional gas powered vehicle, a power circuit for a home or other type of residence, a power circuit for a commercial building, and/or the like. In the exemplary embodiment, the power circuit 12 is a high voltage power circuit, which carries voltages higher than a 12 Volt power circuit typical of conventional gas powered vehicles. The power source 14 may be any type of power source, such as, but not limited to, a battery, a battery pack, an electrical power station, a main breaker, a switch, a junction box, an electrical outlet, and/or the like. In the exemplary embodiment, the power source 14 is a battery pack. The electrical load 16 may be any type of electrical load, such as, but not limited to, a control processor for a vehicle, another vehicle feature (e.g., electrical motors, engines, turn signals, fans, cruise control, energy recapture systems, climate control systems, displays, clocks, instrumentation, lighting systems, audio systems, control systems, comfort features, entertainment features, and/or the like), an appliance, a lighting circuit, a climate control system, a display, an audio system, an electrical motor, an entertainment system, a computer, and/or the like. In the exemplary embodiment, the electrical load 16 is an electrical motor that propels an electric vehicle.

As shown and described herein, the service disconnect assembly 10 is a discrete component from the power source 14 that is electrically connected to the power source 14 through the power cable 22. But, in some alternative embodiments, the service disconnect assembly 10 is a component of the power source 14, wherein the power cable 22 may not be used to electrically connect the service disconnect assembly 10 to the power source 14. A combination of the power source 14 and the service disconnect assembly 10 may be referred to herein as a "power source assembly".

Figure 2:
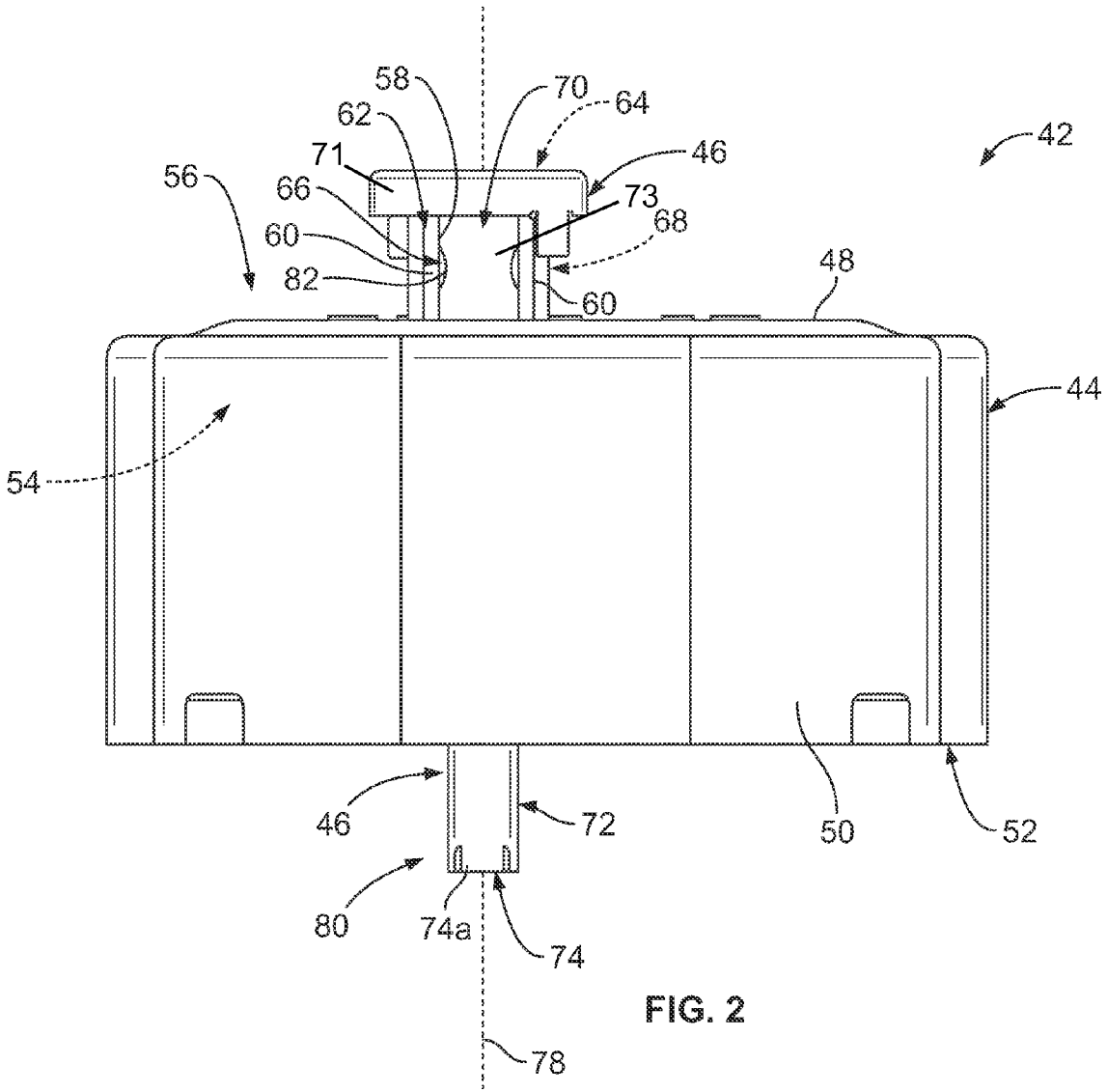
FIG. 2 is a side elevational view of an exemplary embodiment of a lockout device of the service disconnect assembly shown in FIG. 1.
Figure 3:
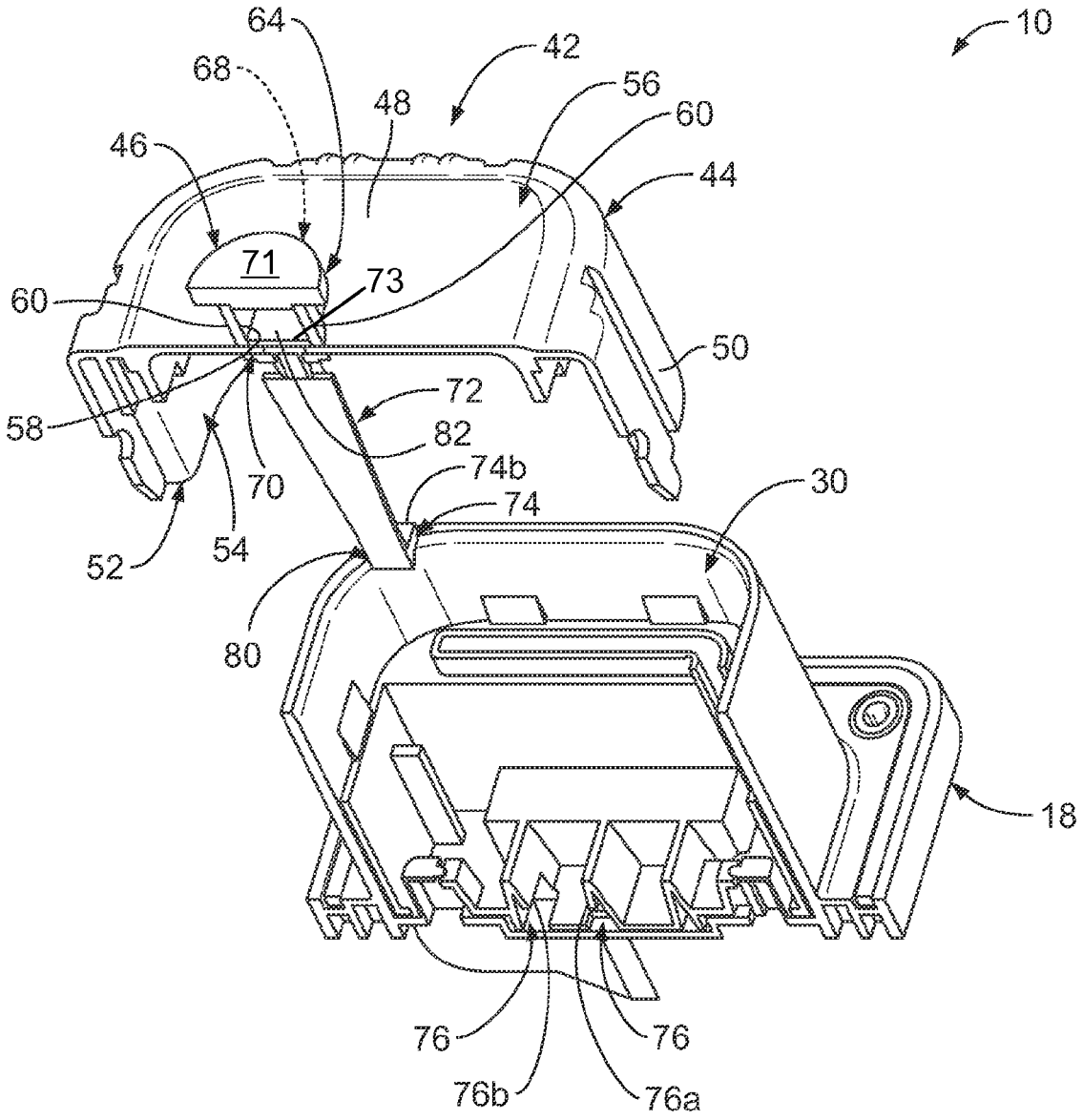
FIG. 3 is a perspective view illustrating a cross section of the service disconnect assembly shown in FIG. 1 including the lockout device shown in FIG. 2.

FIG. 2 is a side elevational view of an exemplary embodiment of the lockout device 42. FIG. 3 is a partially exploded perspective view illustrating a cross section of the service disconnect assembly 10 including the receiver assembly 18 and the lockout device 42. Referring now to FIGS. 2 and 3, the lockout device 42 includes a cover 44 and a latch 46. The cover 44 is configured to be mounted to the receiver assembly 18 to close the fuse receptacle 30 (not shown in FIG. 2), as will be described below. The cover 44 includes a base wall 48 and one or more side walls 50 that extend outwardly from the base wall 48. In the exemplary embodiment, the cover 44 includes a single side wall 50 having a curved shape, such that the cover 44 includes an overall shape of a cylinder. But, the cover 44 may include any overall shape defined by any number of the side walls 50, each which may have any shape. The side wall 50 extends outwardly from the base wall 48 to a free end 52.

The cover 44 includes an interior side 54 and an opposite exterior side 56. The cover 44 includes a channel 58 (also shown in FIG. 4) that extends along the exterior side 56 of the cover 44. Specifically, the cover 44 includes opposing walls 60 that extend outwardly from the exterior side 56 of the base wall 48. In the exemplary embodiment, the walls 60 extend approximately perpendicular from the exterior side 56. The walls 60 are spaced apart such that the channel 58 is defined between the walls 60. In other words, the space between the walls 60 defines the channel 58. The channel 58 extends a length from ends 62 (best seen in FIG. 4 and not visible in FIG. 3) of the walls 60 to opposite ends 64 (best seen in FIG. 4) of the walls 60. At the ends 62 and 64, the channel 58 includes opposite entrances 66 (best seen in FIG. 4 and not visible in FIGS. 3) and 68 (also labeled in FIG. 4), respectively, at which the channel 58 is accessible. The entrances 66 and 68 extend opposite the walls 60. As will be described below, the channel 58 is configured to receive a lock end 70 of a lockout shaft 72 of the latch 46.

The latch 46 of the lockout device 42 is actuatable between a latched position and an unlatched position. The latch 46 is shown in the unlatched position in FIGS. 2 and 3. In the latched position (shown in FIGS. 6 and 8), one or more latch elements 74 of the latch 46 cooperates with one or more latch elements 76 (not shown in FIG. 2) of the receiver assembly 18 (not shown in FIG. 2) to latch the cover 44 to the receiver assembly 18, as will be described below. The latch 46 includes the lockout shaft 72, which includes the latch element(s) 74. The lockout shaft 72 extends a length along a central longitudinal axis 78 (not shown in FIG. 3) from the lock end 70 to a latch end 80.

The lock end 70 of the lockout shaft 72 includes a cap 71 and a generally cylindrical lock retaining segment 73. The lockout shaft 72 is installed through the channel 58 and through an opening in the cover 44 such that the cap 71 is seated on the walls 60 and the lock retaining segment 73 is held within the channel 58. The lockout shaft 72 is held by the cover 44 by the cap 71 of the lockout shaft 72 mating with the walls 60 of the cover 44. The lock end 70 includes a lock opening 82 that extends transversely (relative to the axis 78) through the lock retaining segment 73 of the lock end 70. As will be described below, the lock opening 82 is configured to receive a lock (e.g., the lock 84 shown in FIGS. 7 and 8) therein to lock the latch 46 in the latched position.

The lockout shaft 72 extends through the latch 46 along the central longitudinal axis 78 to the latch end 80. When the cover 44 is mounted to the receiver assembly 18, the latch end 80 extends into the fuse receptacle 30 of the receiver assembly 18. In the exemplary embodiment, the latch end 80 of the lockout shaft 72 includes the latch element(s) 74 of the latch 46. But, the latch element(s) 74 may have any location along the lockout shaft 72 that extends within the fuse receptacle 30 when the cover 44 is mounted to the receiver assembly 18.

In the exemplary embodiment, the latch 46 includes two latch elements 74*a* (FIGS. 2) and 74*b* (FIG. 3). But, the latch 46 may include any other number of latch elements 74. Each latch element 74*a* and 74*b* may be any type of latch element having any structure, configuration, geometry, and/or the like. In the exemplary embodiment, each of the latch elements 74*a* and 74*b* is a tab that extends outwardly on the lockout shaft 72 transversely relative to the central longitudinal axis 78. As should be apparent from a comparison of FIGS. 2 and 3, the latch elements 74*a* and 74*b* extend outwardly on the lockout shaft 72 in opposite directions to each other. Other examples of the type, structure, configuration, geometry, and/or the like of each of the latch elements 74*a* and 74*b* include, but are not limited to, aims, fingers, detents, embossments, recesses, openings, extensions, slots, channels, snap-fit structures, press-fit structures, and/or the like.

The lockout shaft 72 is rotatably held by the cover 44 such that the lockout shaft 72 is configured to rotate relative to the cover 44 about the central longitudinal axis 78. The lockout shaft 72 rotates between the latched and unlatched positions. As described above, the lockout shaft 72 is shown in the unlatched position in FIGS. 2 and 3. In the unlatched position, the lock opening 82 of the lockout shaft 72 is not accessible, while the lock opening 82 is accessible when the lockout shaft 72 is in the latched position. Specifically, when the lockout shaft 72 is in the latched position, the lock opening 82 is generally aligned with the entrances 66 and 68 to the channel 58 of the cover 44. Accordingly, the lock opening 82 is accessible through either of the entrances 66 and 68 to the channel 58 when the lockout shaft 72 is in the latched position. When the lockout shaft 72 is in the unlatched position, the lock opening 82 is blocked, or covered, by the walls 60 that define the channel 58, as can be seen in FIG. 3.

Referring now solely to FIG. 3, the receiver assembly 18 includes the latch element(s) 76 within the fuse receptacle 30 that each cooperate with the corresponding latch element 74 of the lockout device 42. In the exemplary embodiment, the receiver assembly 18 includes two latch elements 76*a* and 76*b*. But, the receiver assembly 18 may include any other number of latch elements 76. In the exemplary embodiment, the latch elements 76*a* and 76*b* are openings that receive the tabs of the latch elements 74*a* and 74*b*, respectively, therein. But, each latch element 76*a* and 76*b* may be any type of latch element having any structure, configuration, geometry, and/or the like that enables the latch element 76*a* and 76*b* to cooperate with the respect latch element 74*a* and 74*b*. Other examples of the type, structure, configuration, geometry, and/or the like of each of the latch elements 76*a* and 76*b* include, but are not limited to, arms, fingers, detents, embossments, recesses, extensions, slots, channels, snap-fit structures, press-fit structures, and/or the like. In some alternative embodiments, the latch element 74*a* and/or the latch element 74*b* is an opening and the respective latch element 76*a* and/or 76*b* is a tab that is configured to be received within the corresponding opening.

Figure 5:
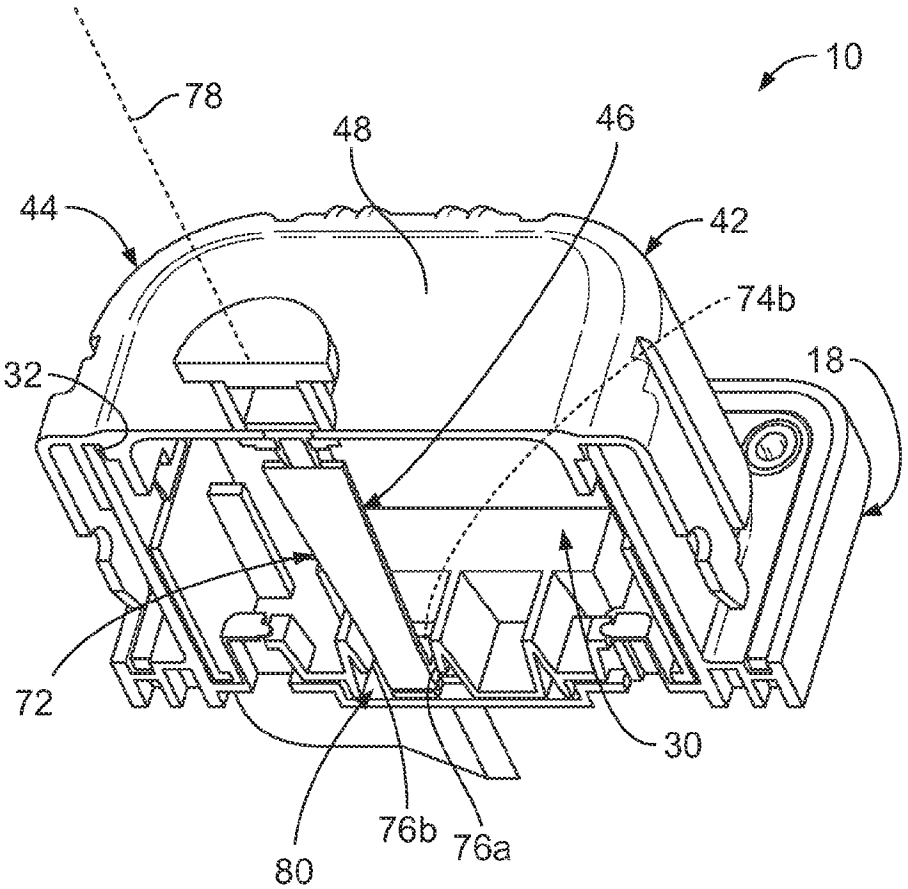
FIG. 5 is a perspective view illustrating a cross section of the service disconnect assembly shown in FIGS. 1, 3, and 4 when the lockout device shown in FIG. 2 is mounted to the receiver as shown in FIG. 4.
Figure 4:
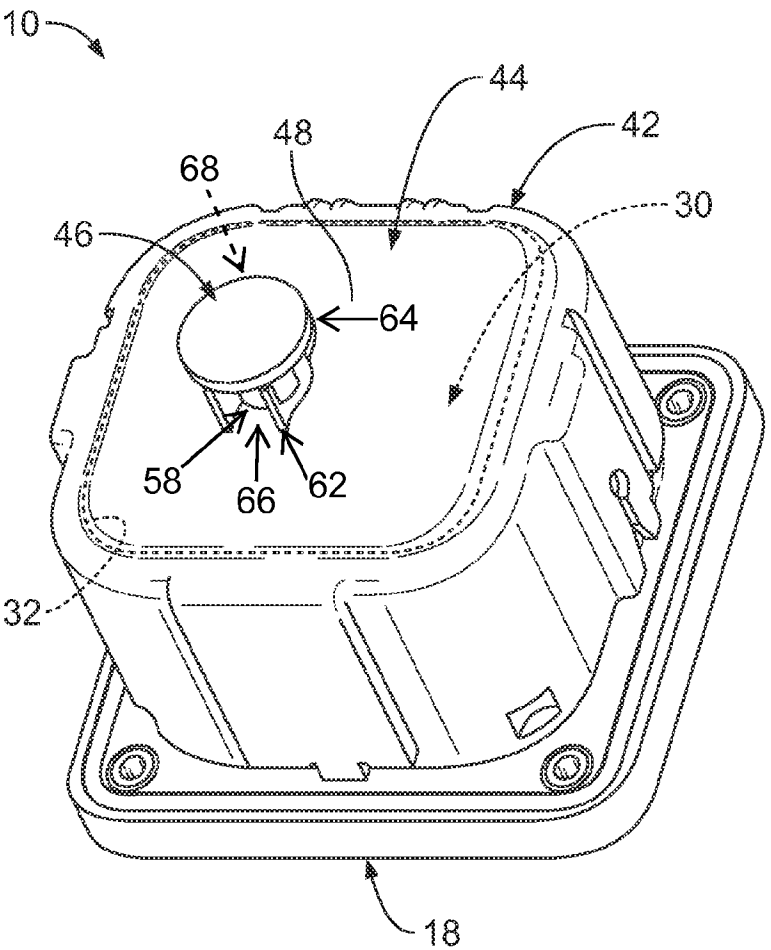
FIG. 4 is a perspective view of the service disconnect assembly shown in FIGS. 1 and 3 illustrating the lockout device shown in FIG. 2 mounted to an exemplary embodiment of a receiver of the service disconnect assembly.

FIG. 4 is a perspective view of the service disconnect assembly 10 illustrating the lockout device 42 mounted to the receiver assembly 18. FIG. 5 is a perspective view illustrating a cross section of the service disconnect assembly 10 wherein the lockout device 42 is mounted to the receiver assembly 18. FIGS. 4 and 5 illustrate the latch 46 of the lockout device 42 in the unlatched position. Referring now to FIGS. 4 and 5, the cover 44 of the lockout device 42 is mounted to the receiver assembly 18 such that the cover 44 closes the fuse receptacle 30 of the receiver assembly 18. In the exemplary embodiment, the cover 44 completely closes the fuse receptacle 30. In other words, in the exemplary embodiment, the base wall 48 of the cover 44 blocks, or covers, an approximate entirety of the entrance 32 to the fuse receptacle 30. But, the cover 44 is not limited to completely closing the fuse receptacle 30. Rather, as used herein, the fused receptacle is considered to be "closed" by the cover 44 when the fuse receptacle 30 is inaccessible for receiving the fuse 20 (FIG. 1) therein. In other words, the fuse receptacle 30 is considered to be "closed" by the cover 44 when the fuse 20 cannot be installed into the fuse receptacle 30 in electrical connection with the terminals 38 (FIG. 1). Thus, to "close" the fuse receptacle 30, the cover 44 need only block an amount of the entrance 32 to the fuse receptacle 30 that is sufficient to prevent the fuse 20 from being installed into the fuse receptacle 30 in electrical connection with the terminals 38. Accordingly, in some alternative embodiments, the cover 44 closes the fuse receptacle 30 by blocking only a portion of the entrance 32. In some embodiments, the fuse receptacle 30 is considered to be "closed" by the cover 44 when the fuse 20 cannot be removed from the fuse receptacle 30.

Referring now solely to FIG. 5, when the cover 44 is mounted to the receiver assembly 18 as shown in FIGS. 4 and 5, the latch end 80 of the lockout shaft 72 of the latch 46 extends within the fuse receptacle 30. In the unlatched position shown in FIG. 5, the tabs of the latch elements 74*a* and 74*b* of the lockout device 42 are not received within the openings of the latch elements 76*a* and 76*b*, respectively, of the receiver assembly 18. The latch element 74*b* is not shown in FIG. 5. The cover 44 can be latched in the mounted position by actuating the latch 46 from the unlatched position shown in FIG. 5 to the latched position. The latch 46 is actuated from the unlatched position to the latched position by rotating the lockout shaft 72. In the exemplary embodiment, the lockout shaft 72 is rotated in a counter-clockwise direction (as viewed in FIG. 5) to move from the unlatched position to the latched position. In addition or alternatively, the lockout shaft 72 may be rotated in a clockwise direction (as viewed in FIG. 5) to move from the unlatched position to the latched position.

Figure 6:
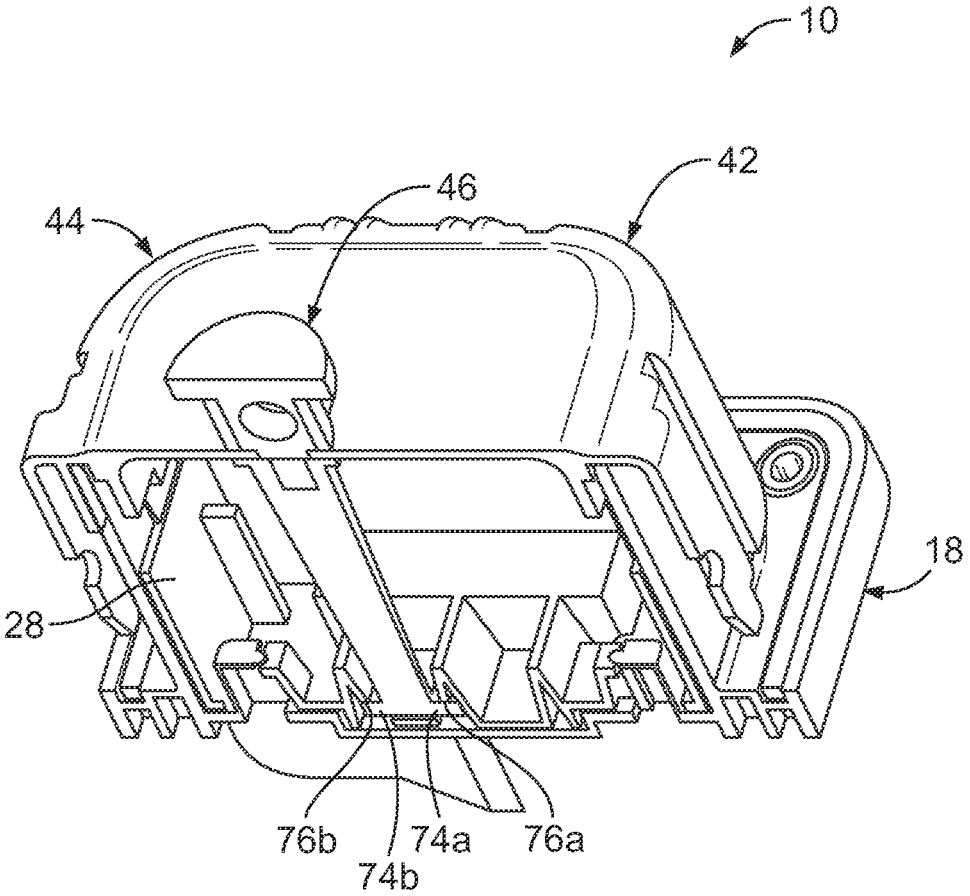
FIG. 6 is another perspective view illustrating a cross section of the service disconnect assembly shown in FIGS. 1 and 3-5 wherein the lockout device shown in FIG. 2 is in a latched position.

FIG. 6 illustrates the latch 46 of the lockout device 42 in the latched position. Specifically, the lockout shaft 72 has been rotated such that the tabs of the latch elements 74*a* and 74*b* of the lockout device 42 are received within the openings of the respective latch elements 76*a* and 76*b* of the receiver assembly 18. In the latched position, the latch elements 74*a* and 74*b* cooperate with the latch elements 76*a* and 76*b*, respectively, such that the cover 44 cannot be dismounted, or removed, from the receiver assembly 18. In the exemplary embodiment, the tabs of the latch elements 74*a* and 74*b* are configured to engage the latch elements 76*a* and 76*b*, respectively, when the lockout shaft 72 is in the latched position to prevent the cover 44 from being dismounted from the receiver assembly 18. For example, the tabs of the latch elements 74*a* and 74*b* may engage segments of the insert 28 that define the openings of the latch elements 76*a* and 76*b*, respectively, to prevent the cover 44 from being dismounted from the receiver assembly 18. In the latched position, the tabs of the latch elements 74*a* and/or 74*b* may have a tight, or snug, fit within the openings of the latch elements 76*a* and 76*b*, respectively. But, the tabs of the latch elements 74*a* and/or 74*b* may be capable of floating within the openings of the respective latch elements 76*a* and/or 76*b*, respectively, when the lockout shaft 72 is in the latched position.

When the latch 46 is in the latched position, the cover 44 cannot be dismounted from the receiver assembly 18 without actuating the latch 46 from the latched position to the unlatched position. In other words, in the latched position, the latch 46 holds the cover 44 on the receiver assembly 18.

As briefly described above, the cover 44 of the lockout device 42 can be locked onto the receiver assembly 18 to prevent the fuse 20 (FIG. 1) from being installed into the receiver assembly 18 without unlocking and unlatching the lockout device 42. Specifically, the latch 46 of the lockout device 42 can be locked in the latched position such that the cover 44 cannot be dismounted from the receiver assembly 18 without unlocking the latch 46 and actuating the latch 46 from the latched position to the unlatched position.

Figure 8:
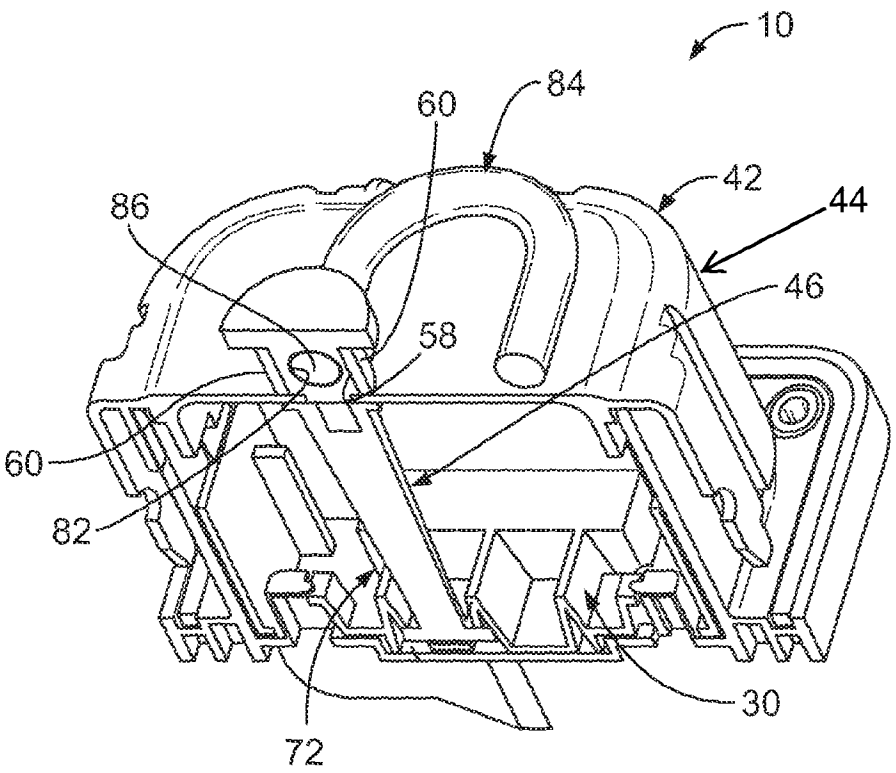
FIG. 8 is a perspective view illustrating a cross section of the service disconnect assembly shown in FIGS. 1 and 3-7 when the lockout device shown in FIG. 2 is locked in the latched position.
Figure 7:
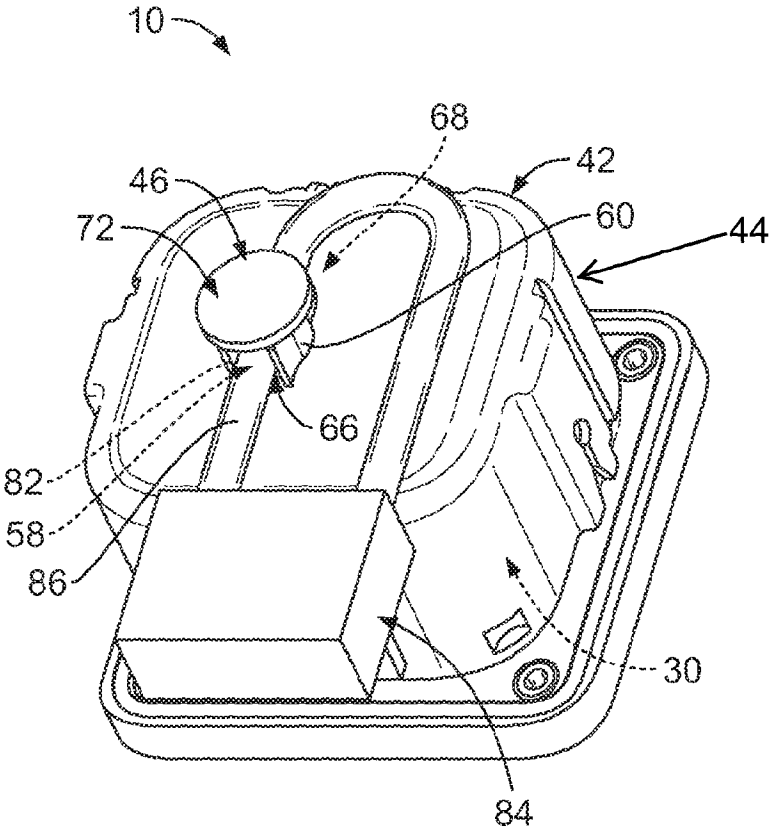
FIG. 7 is a perspective view of the service disconnect assembly shown in FIGS. 1 and 3-6 illustrating the lockout device shown in FIG. 2 locked in the latched position.

The latch 46 can be locked in the latched position using any type of lock. FIGS. 7 and 8 illustrate the latch 46 of the lockout device 42 being locked in the latched position using the exemplary lock 84. Referring now to FIGS. 7 and 8, the lock opening 82 is generally aligned with the entrances 66 and 68 to the channel 58 of the cover 44 such that the lock opening 82 is accessible through either of the entrances 66 and 68. The lock 84 includes a locking member 86 that is received within the lock opening 82 of the lockout shaft 72. When the locking member 86 of the lock 84 is received within the lock opening 82, the locking member 86 prevents the lockout shaft 72 of the latch 46 from being rotated from the latched position to the unlatched position. Specifically, upon attempting to rotate the lockout shaft 72 to the unlatched position, engagement between the locking member 86 and one or both of the walls 60 that define the channel 58 of the cover 44 will prevent the lockout shaft 72 from being rotated to the unlatched position.

Accordingly, the lock 84 locks the latch 46 of the lockout device 42 in the latched position such that the cover 44 is locked onto the receiver assembly 18. The cover 44 therefore cannot be dismounted from the receiver assembly 18 without unlocking the lock 84 and actuating the latch 46 from the latched position to the unlatched position. As described above, when the cover 44 is mounted to the receiver assembly 18, the cover 44 closes the fuse receptacle 30 such that the fuse 20 (FIG. 1) cannot be installed into the fuse receptacle 30 in electrical connection with the terminals 38 (FIG. 1). Accordingly, by locking the latch 46 in the latched position using the lock 84, the fuse 20 is prevented from completing the electrical path between the terminals 38. Electrical power is thereby preventing from flowing through the service disconnect assembly 10 from the power source 14 (FIG. 1) to the electrical load 16 (FIG. 1).

To unlock the lock 84 and thereby enable the locking member 86 to be removed from the lock opening 82, the lock 84 may require unlocking information and/or an unlocking structure. Unlocking information includes, but is not limited to, a numeric code or combination, a password, a passcode, and/or the like. Unlocking structure includes, but is not limited to, a key, a key card, a key fob, a security token, and/or the like. Accordingly, a person may need to have the unlocking information and/or unlocking structure to unlock the lock 84 and ultimately reinstall the fuse 20.

In the exemplary embodiment, the locking member 86 of the lock 84 extends completely through the lock opening 82, but it should be understood that the locking member 86 may extend only partially through the lock opening 82 so long as the locking member 86 prevents the latch 46 from being actuated from the latched position to the unlatched position.

The lock 84 may be any type of lock having any structure, configuration, geometry, and/or the like that enables the lock 84 to prevent the latch 46 from being actuated from the latched position to the unlatched position. Examples of suitable types of locks 84 include, but are not limited to, combination locks, keyed locks, chain locks, bike locks, passcode locks, and/or the like. In the exemplary embodiment, the lock 84 is a pad lock, which may require a key and/or a numeric combination to be unlocked. The lock 84 may be a discrete component relative to the cover 44 and the latch 46 of the lockout device 42, for example as in the exemplary lock 84. Alternatively, the lock 84 may be a component of (e.g., integrally formed with) the cover 44 and/or the latch 46.

In some embodiments, the lockout device 42 may be used with the service disconnect assembly 10 when the fuse 20 is installed within the receiver assembly 18. In other words, in some embodiments, the lockout device 42 may be used to lock the service disconnect assembly 10 in a state wherein the service disconnect assembly 10 completes the electrical path between the power source 14 and the electrical load 16. For example, in some embodiments, the latch 46 of the lockout device 42 may be capable of being latched in the latched position, and locked therein by the lock 84, when the fuse 20 is installed within the fuse receptacle 30.

The embodiments described and/or illustrated herein may provide a lockout device that facilitates preventing a fuse from being installed within a service disconnect assembly. For example, the lockout device may facilitate preventing a fuse from being installed within a service disconnect assembly during service and/or repair of a component (e.g., an electronic module, a power source, an electrical load, and/or the like) of a power circuit of which the service disconnect forms a part. Moreover and for example, the lockout device may facilitate preventing a fuse from being installed within a service disconnect assembly during response to an accident by a first responder. The embodiments described and/or illustrated herein may facilitate protecting an operator or technician from being exposed to electrical power during service and/or repair of a component of a power circuit. The embodiments described and/or illustrated herein may facilitate protecting a first responder from exposure to electrical power during response to an accident.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A service disconnect assembly for disconnecting power to a power circuit, the service disconnect assembly comprising:

a receiver assembly comprising a fuse receptacle that is configured to receive a fuse therein, the receiver assembly comprising a latch element that extends within the fuse receptacle; and a lockout device mountable to the receiver assembly when the fuse is removed to prevent the fuse from being loaded into the fuse receptacle, the lockout device comprising a latch having a lockout shaft that extends from a lock end to a latch end, the latch end having a latch element, the latch being actuatable between a latched position and an unlatched position, the latch cooperating with the receiver assembly in the latched position such that the lockout device cannot be removed from the receiver assembly, the latch elements of the lockout shaft and the receiver assembly engaging each other when the latch is in the latched position to prevent the lockout device from being dismounted from the receiver assembly, wherein the latch is lockable in the latched position.

2. The service disconnect assembly of claim 1, wherein the latch is lockable in the latched position using a lock.

3. The service disconnect assembly of claim 1, wherein the lockout shaft rotates between the latched and unlatched positions.

4. The service disconnect assembly of claim 1, wherein the lockout shaft moves when the latch is actuated between the latched and unlatched positions, the lockout shaft comprising a lock opening receiving a lock therein, the lock opening being accessible when the lockout shaft is in the latched position, the lock opening being inaccessible when the lockout shaft is in the unlatched position.

5. The service disconnect assembly of claim 1, wherein the lockout device comprises a cover mounted to the receiver assembly such that the cover closes the fuse receptacle, wherein the cover cannot be dismounted from the receiver assembly for accessing the fuse receptacle when the latch is in the latched position.

6. The service disconnect assembly of claim 1, wherein the lockout device comprises a cover having a channel defined between opposing walls, the lock end rotates between the latched and unlatched positions, the lockout shaft comprising a lock opening that extends transversely through the lock end, the lock opening being accessible through an entrance to the channel when the lockout shaft is in the latched position, the lock opening being blocked by the walls of the channel when the lockout shaft is in the unlatched position.

7. The service disconnect assembly of claim 1, wherein the latch element of the receiver assembly comprising an opening, the latch element of the latch comprising a tab that is received within the opening when the latch is in the latched position.

8. The service disconnect assembly of claim 1, wherein the latch is locked in the latched position using at least one of a combination lock, a pad lock, a keyed lock, a chain lock, a bike lock, or a passcode lock.

9. The service disconnect assembly of claim 1, wherein the lockout shaft passes through a space otherwise occupied by the fuse when the fuse is received in the fuse receptacle.

10. A service disconnect assembly for disconnecting power to a power circuit, the service disconnect assembly comprising:

a receiver assembly holding terminals of the power circuit in a spaced apart relationship, the receiver assembly comprising a fuse receptacle that is configured to receive a fuse therein that completes an electrical path between the terminals, the receiver assembly further comprising a latch element; and a lockout device comprising a cover mounted to the receiver assembly to close the fuse receptacle such that the fuse receptacle is inaccessible for receiving the fuse therein, the cover locked onto the receiver assembly using a lock such that the cover cannot be dismounted from the receiver assembly without unlocking the lock, the lockout device further comprising a latch that is actuatable between a latched position and an unlatched position, the latch comprising a lock opening receiving the lock therein, the lock opening being accessible when the latch is in the latched position, the lock opening being inaccessible when the latch is in the unlatched position.

11. The service disconnect assembly of claim 10, wherein the latch holds the cover on the receiver assembly when the latch is in the latched position, the latch being locked in the latched position when the lock is loaded in the lock opening to lock the cover onto the receiver assembly.

12. The service disconnect assembly of claim 10, wherein the latch includes a lockout shaft passing through a space otherwise occupied by the fuse when the fuse is received in the fuse receptacle.

13. The service disconnect assembly of claim 10, wherein the cover has a channel defined between opposing walls, the latch comprising a lockout shaft having a lock end that rotates between the latched and unlatched positions, the lock opening extends transversely through the lock end, the lock opening being accessible through an entrance to the channel when the lockout shaft is in the latched position, the lock opening being blocked by the walls of the channel when the lockout shaft is in the unlatched position.

14. The service disconnect assembly of claim 10, wherein the latch has a lockout shaft that extends from a lock end to a latch end, the latch end having a latch element, the latch elements of the lockout shaft and the receiver assembly engaging each other when the latch is in the latched position to prevent the lockout device from being dismounted from the receiver assembly.

15. A power source assembly comprising:

a power source; and a service disconnect assembly operatively connected to the power source for selectively supplying electrical power from the power source to an electrical load, the service disconnect assembly comprising:

a receiver assembly holding terminals of a power circuit in a spaced apart relationship, the receiver assembly comprising a fuse receptacle receiving a fuse therein that completes an electrical path between the terminals, the receiver assembly further comprising a latch element; and a lockout device mountable to the receiver assembly when the fuse is removed to prevent the fuse from being loaded into the fuse receptacle, the lockout device comprising a cover and a latch, the cover mounted to the receiver assembly to close the fuse receptacle, the latch being actuatable between a latched position and an unlatched position, the latch cooperating with the latch element of the receiver assembly in the latched position such that the cover cannot be removed from the receiver assembly, the latch comprises a lockout shaft that includes a latch element, the lockout shaft being rotatably held by the cover such that the lockout shaft rotates between the latched and unlatched positions, wherein the latch element of the lockout shaft engages the latch element of the receiver assembly when the lockout shaft is in the latched position to prevent the cover from being dismounted from the receiver assembly, wherein the latch is lockable in the latched position.

16. The power source assembly of claim 15, wherein the latch is lockable in the latched position using a lock.

17. The power source assembly of claim 15, wherein the lockout shaft comprising a lock opening receiving a lock therein, the lock opening being accessible when the lockout shaft is in the latched position, the lock opening being inaccessible when the lockout shaft is in the unlatched position.

18. The power source assembly of claim 15, wherein the cover comprises a channel defined between opposing walls, the lockout shaft having a lock end that extends within the channel of the cover, the lockout shaft comprising a lock opening that extends transversely through the lock end, the lock opening being accessible through an entrance to the channel when the lockout shaft is in the latched position, the lock opening being blocked by the walls of the channel when the lockout shaft is in the unlatched position.

19. The power source assembly of claim 15, wherein the latch element of the receiver assembly comprising an opening, the latch element of the latch comprising a tab that is received within the opening when the latch is in the latched position.

20. The power source assembly of claim 15, wherein the lockout shaft passes through a space otherwise occupied by the fuse when the fuse is received in the fuse receptacle.

* * * * *